United States Patent [19]

Rosenwinkel et al.

[11] Patent Number: 4,526,376

[45] Date of Patent: Jul. 2, 1985

[54] GAME WITH CARDS

[75] Inventors: Donald A. Rosenwinkel, Oak Park; Jeffrey D. Breslow, Highland Park; John V. Zaruba, Chicago, all of Ill.

[73] Assignee: Marvin Glass & Associates, Chicago, Ill.

[21] Appl. No.: 463,635

[22] Filed: Feb. 3, 1983

[51] Int. Cl.[3] ..... A63F 3/00

[52] U.S. Cl. ..... 273/249; 273/283; 273/284

[58] Field of Search ..... 273/243, 246, 248, 249, 273/283, 284, 275, 276, 258

[56] References Cited

U.S. PATENT DOCUMENTS

| | | | |
|---|---|---|---|
| 1,224,173 | 5/1917 | Kajiyama | 273/283 X |
| 3,512,779 | 5/1970 | McGaughey | 273/275 |
| 3,692,310 | 9/1972 | Martin | 273/283 X |
| 4,317,570 | 3/1982 | Brunton | 273/246 |

FOREIGN PATENT DOCUMENTS

| | | | |
|---|---|---|---|
| 340173 | 9/1959 | Switzerland | 273/246 |
| 808937 | 2/1959 | United Kingdom | 273/246 |
| 1174676 | 12/1969 | United Kingdom | 273/243 |

OTHER PUBLICATIONS

"Waterworks" ® Parker Brothers Catalog 1980.
"AC/DC" advertising brochure, Nov. 15, 1976.

*Primary Examiner*—Richard C. Pinkham
*Assistant Examiner*—Scott L. Brown
*Attorney, Agent, or Firm*—John S. Pacocha

[57] ABSTRACT

A game with cards in which the cards are used to build a path for moving a player token in accordance with the roll of a die to reach a goal. The deck of cards includes, in addition to the goal card, a number of girder and ladder path building cards plus obstacle and obstacle-overcoming cards. All of the cards have indicia simulating element of the "DONKEY KONG" Video arcade game. After the initial setup, each player turn consists of drawing a card from a common stack; laying down a card to build a path, place an obstacle, or clear an obstacle; rolling the die; and moving the token toward the "DONKEY KONG" goal. The goal is advanced, however, if a player builds an additional level with the cards.

8 Claims, 1 Drawing Figure

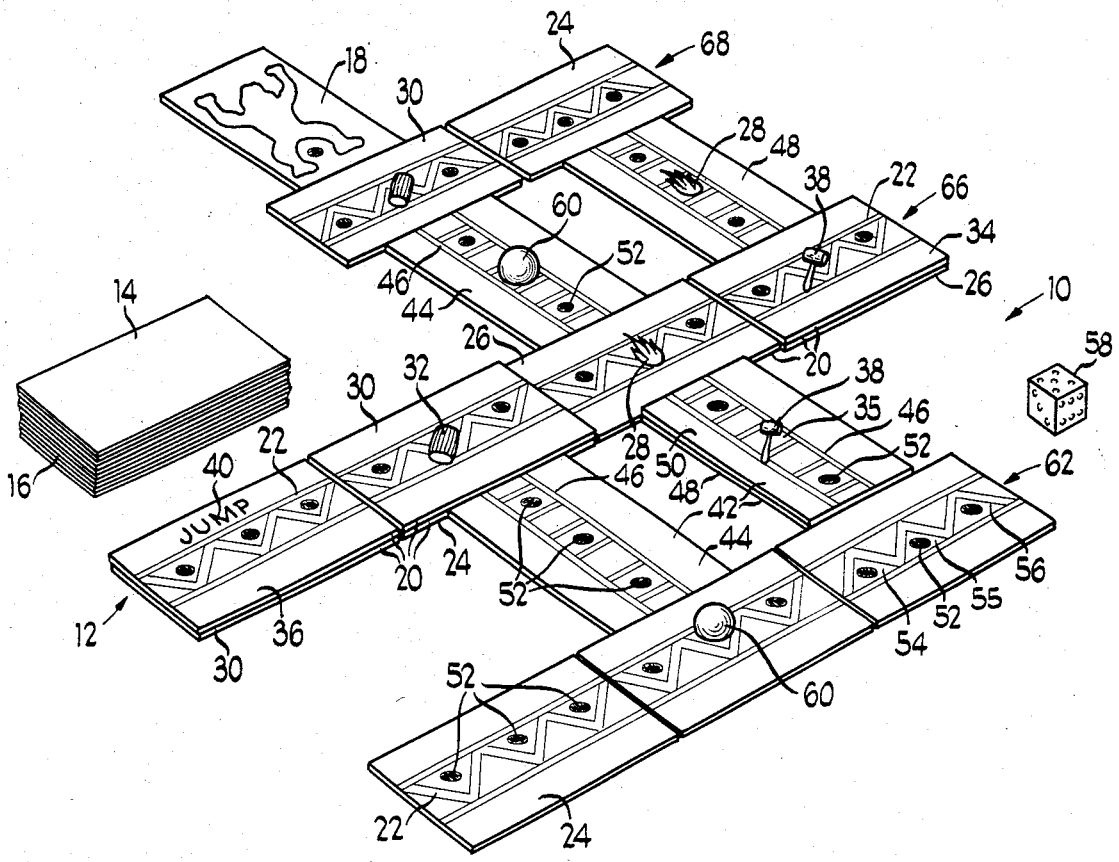
JUMP

GAME WITH CARDS

BACKGROUND OF THE INVENTION

1. Field of the Invention

This invention relates generally to games and more particularly to games with cards.

2. Background Art

Games with cards including matching or pairing games such as the classic "Old Maid" and the game of U.S. Pat. No. 3,953,027 as well as trick playing card games such as that of U.S. Pat. No. 4,071,247 and the classics of "Bridge" and "Pinochle" have long been popular pastimes. Another popular type of game is that usually embodied in a board game wherein the players, using a chance device, move respective markers along a path to reach a goal and along the way encounter various obstacles and possibly obtain benefits. One disadvantage of such popular board games is the requirement for the board, which not only increases the initial expense of obtaining the game but may also present some storage problems and restricts the portability of the game. Yet another leisure time pursuit of more recent vintage is the video game which represents substantial investment of money in order to play and has inherent limitations insofar as when and where the game may be enjoyed.

SUMMARY OF THE INVENTION

The present invention is concerned with providing a game with cards that has the versatility, plus the ease of portability and storage of prior art card games, as well as the adventure and goal attainment of board games with the flavor of at least one popular video game. These and other objects and advantages of the invention are achieved by a game including a deck of cards, a chance device, and a token for each player in which the deck has a goal card and two suits of path building cards. The two suits include path blocking and obstacle clearing cards for building a path from a starting point to reach the goal. Each of the cards includes a plurality of spaces for movement of the marker in accordance with the roll of the die chance device. The goal card bears an illustration of the "Donkey Kong" ape figure of the Nintendo "Donkey Kong" video game while the path building cards are in "Girder" and "Ladder" suits. "Fireball" and "Barrel" indicia identify the obstacle cards while "Hammer" and "Jump" indicia identify the path clearing cards.

BRIEF DESCRIPTION OF THE DRAWING

For a better understanding of the present invention, reference may be had to the accompanying drawing in which the single FIGURE shows an embodiment of the present invention in the progress of play.

DETAILED DESCRIPTION OF THE PREFERRED EMBODIMENT

Referring now to the drawing a game 10 including a deck of playing cards 12 is shown in progress on a playing surface such as a table or any other conveniently available, plain, generally flat surface. Each of the cards has a back 14 that may be provided with any suitable convenient decoration. The back of the cards is not significant in the play of the game other than to hide the identity of the cards in the common stack 16. On the other side of each of the cards 12 there is an indicia related to the Nintendo of America Inc. "Donkey Kong" game that is useful in implementing the play of the game of the present invention.

Deck of cards 12 has a goal card 18 which bears a simulation of the ape "Donkey Kong" from the "Donkey Kong" video arcade game. The rest of the deck consists of two suits of cards usable in constructing a path to the goal card 18. One suit 20, bearing "Girder" indicia 22, has a plurality of plain "Girder" cards 24. In addition, the "Girder" suit 20 includes obstacle cards 26 which have a "Fireball" indicia 28 superimposed on the center of a "Girder" indicia 22 and the "Barrel" type 30 which have a "Barrel" indicia 32 superimposed on the "Girder" indicia 22. Also included in the "Girder" suit 20 are obstacle overcoming or clearing cards 34 and 36 which bear a "Hammer" indicia 38 and a "Jump" indicia 40 respectively over the center of the "Girder" indicia 22. A second suit 42 of "Ladder" path building cards includes cards 44 which bear a plain "Ladder" indicia 46 as well as obstacle cards 48 which have the "Fireball" indicia 28 superimposed on a "Ladder" 46 and obstacle overcoming or clearing cards 50 with "Hammer" indicia 38 on the "Ladder" indicia 46.

All of the path cards have dot indicia 52 identifying three distinct spaces or positions 54, 55 and 56. On the obstacle or path blocking cards 26, 30 and 48 as well as on the obstacle clearing cards 34 and 50, the two end spaces 54 and 56 are identified by the same dot indicia 52 as on the plain "Girder" cards 24, plain "Ladder" cards 44 and the "Jump" clearing cards 36; however, the center space 55 is designated by "Fireball" 28, "Barrel" 32 or "Hammer" 38 indicia.

The number of the total cards as well as the breakdown of the different suits and types of cards are amenable to modification and chance which will in part depend on the age and number of players to which the game is directed. Moreover, various indicia could be employed, including indicia other than those shown relating to the "Donkey Kong" video arcade game and of course indicia relating to other games or real-life events or more abstract indicia could be employed. A deck totalling seventy-three cards has been found to provide play which offers a sufficient variety of strategy choices while enabling completion of an individual game or round within a reasonable time. The following breakdown of the deck of cards 12 has been found convenient:

50 "Girder" suit cards consisting of:
20 plain
10 "Barrel"
5 "Fireball"
10 "Jump"
5 "Hammer"
22 "Ladder" suit cards consisting of:
12 plain
5 "Fireball"
5 "Hammer"
1 "Donkey Kong"

In addition, a chance selection device 58 conveniently in the form of a six-sided die bearing number indicia from "1" to "6" and a token 60 for each player provide all that is needed for play and enjoyment of the game of the present invention by two to six players.

In order to initiate play of the game, the "Donkey Kong" card 18 is removed from the deck and is temporarily set aside. A number of plain "Girder" cards 24 are removed from the deck and aligned as illustrated in the drawing to form a base "Girder" level 62. Three of the "Girder" cards have been found to provide a suitable start for the game. The remainder of the cards are then shuffled and a predetermined number are dealt to each of the players. An initial deal of seven cards to each player has been found to be a number that provides enjoyable play. Once the cards have been dealt and the order of play determined by any one of a number of conventional ways, the first player's turn begins. Each turn consists of the steps of placing a card from the hand onto the playing surface, then rolling the die 58, followed by moving the token 60 the number of spaces shown on the die along the already placed cards, and finally drawing a new card from the common stack 16. The sequence within the turn could, of course, be varied by permitting the player to draw a new card from the deck 16 before playing a card on the surface. Similarly, other rules such as that the player's token must be moved the exact number of spaces corresponding to the numerical indicia on the top surface of the rolled die could be changed. Again, however, such rules along with other described requirements and limitations have been found to provide good play.

At the start each player selects one of the cards in the base "Girder" level 62 as a starting point before rolling the die. Whatever card is selected the player's marker is initially placed on the center space 55 of the selected card. Once the player rolls the die 58, the player's token 60 must be moved the exact number of spaces corresponding to the numerical indicia on the top of the rolled die. In moving the token 60, the player may make right angle changes in direction but may not reverse direction during a turn. A token may not cross a "Fireball" 28 on a "Girder" 22 or "Ladder" 46 or a "Barrel" 32 on obstacle card 30, nor may a player jump over an opponent's token. If a die roll is such that a player cannot complete the entire move because the path is blocked by obstacle indicia 28 or 32 or by an opponent's token, the player "falls" off the structure built with the laid down cards and must return to the center space 55 of one of the cards in the base level 62.

The players use the cards dealt and those picked from the stack 16 to build a path of "Girder" and "Ladder" cards to reach the goal or "Donkey Kong" card 18. Plain "Girder" cards 24 and the "Girder" obstacle cards 26 and 30 may be placed on the playing surface end-to-end with any other "Girder" suit card already laid down such as the three "Girder" cards 24 in the base level 62. Once one or more "Ladder" suit cards are laid down, a "Girder" suit card may be centered above a "Ladder" suit card as, for example, cards 30 are positioned above cards 44. Thus, it will be appreciated that the "Girder" suit cards are used to build spaced parallel, substantially horizontal, paths. The "Girder" obstacle cards 26 and 30 may also be placed on top of a plain "Girder" card 24 already on the playing surface such as has been done with the "Barrel" card 30 in the second "Girder" level 66. Obstacle clearing cards 34 and 36 may only be played on top of or covering an obstacle card 26 and 30. It has also been found to enhance the play of the game if the "Jump" clearing cards 36 are playable only atop the "Barrel" cards 30 and the "Hammer" clearing cards 34 only atop the "Fireball" obstacle cards 26 as illustrated in the drawing.

The "Ladder" suit cards 42 are played vertically and both the plain "Ladder" cards 44 and the "Fireball" obstacle cards 48 may be placed directly on the playing surface centered above any laid down card of the "Girder" suit 20. In addition, the "Ladder" obstacle cards 48 may be played on top of or covering a plain "Ladder" card 44 already in place on the surface. As with the "Girder" suit clearing cards the "Ladder" clearing cards 50 are only playable to cover a "Fireball" card 48 as has been done with the "Hammer" card 50 in the drawing. A variation of the game may be provided by permitting the path clearing cards to be played directly on the surface in addition to covering a plain or obstacle card. Once a "Jump" or "Hammer" card has been played, no other type of card may be played to cover it. No card of any type may be played on top of a card occupied by a token 60.

When the third "Girder" level 68 is established by the play of the first "Girder" suit card on that level, the "Donkey Kong" goal card 18 is immediately centered above that "Girder" card. In order to win the player must land on the goal card 18 by an exact count. Subsequently third level "Girder" suit cards may be played without affecting the placement of the "Donkey Kong" card 18. However, if a player lays down a "Ladder" card centered above another third level "Girder" card and a fourth "Girder" level (not shown) is later established, the "Donkey Kong" card must then be moved to a position centered above the first "Girder" card played in the higher level. Additionally higher levels may be established in a like manner with the goal card always being positioned above the highest "Girder" level as soon as it is established. The game or round ends when the first player reaches the goal and captures "Donkey Kong". Again, as an alternative, if there are more than two players the game could continue as an elimination until only one of the players has not reached the goal.

While a particular embodiment including some variations have been shown and described, other changes and modifications will become apparent to those skilled in the art. It is intended in the appended claims to cover all such changes and modifications that fall within the true spirit and scope of the present invention.

What is claimed as new and desired to be secured by Letters Patent is:

1. A method of playing a game with cards, a chance device and a token for each of at least two players on a playing surface comprising the steps of:

initially placing at least one card on the playing surface to establish a base;

establishing a goal on the playing surface remote from the initially placed card;

providing each of the players with at least one of the remaining cards to place in a turn;

each player in turn placing a card adjacent or covering a card already placed on the playing surface, operating the chance device, and moving the token on the cards placed on the playing surface in accordance with indicia on the cards;

placing the cards on the playing surface to build a path from the base to at least a predetermined level;

positioning the goal adjacent the first card reaching the predetermined level;

increasing the path beyond the predetermined level by placing additional cards on the playing surface; and moving the goal to adjacent the first card on the increased level.

2. The method of claim 1 wherein the cards are comprised of two different sets, and including the steps of:

placing cards of one set on the playing surface to build a path transverse to the base and placing cards of another set above the one set to build a path parallel to the base at a higher level.

3. The method of claim 1 including the steps of:

dealing hands of less than all of the cards to each player;

putting the remaining cards in a common stack; and each player picking one or more cards from the common deck as part of the turn.

4. The method of claim 1 including the steps of:

alternatively extending the base; and building a path substantially parallel to the base above a previously built transverse path.

5. A method of playing a game with cards, a chance device and a token for each of at least two players on a playing surface comprising the steps of:

initially placing at least one card on the playing surface to establish a base;

establishing a goal on the playing surface remote from the initially placed card;

providing each of the players with at least one of the remaining cards to place in a turn;

each player in turn placing either a path card adjacent a card already placed on the playing surface to build a path, an obstacle card adjacent a card or covering a path card to block a path, or an obstacle overcoming path clearing card covering an obstacle card to clear a blocked path, operating the chance device, and moving the token on the cards placed on the playing surface in accordance with indicia on the cards;

placing the cards on the playing surface to build a path from the base to at least a predetermined level;

positioning the goal adjacent the first card reaching the predetermined level;

increasing the path beyond the predetermined level by placing additional cards on the playing surface; and moving the goal to adjacent the first card on the increased level.

6. The method of claim 5 including the steps of:

alternatively extending the base; and building a path substantially parallel to the base above a previously built transverse path.

7. The method of claim 5 including the steps of:

placing cards of one set on the playing surface to build a path transverse to the base and placing cards of another set above the one set to build a path parallel to the base at a higher level.

8. The method of claim 5 including the steps of:

dealing hands of less than all of the cards to each player;

putting the remaining cards in a common stack; and each player picking one or more cards from the common deck as part of the turn.

* * * * *